US006654568B2

(12) United States Patent
Matsuguma

(10) Patent No.: US 6,654,568 B2
(45) Date of Patent: Nov. 25, 2003

(54) IMAGE FORMING APPARATUS, IMAGE BEARING MEMBER LIFE DETECTING METHOD, AND PROCESS CARTRIDGE DETACHABLY ATTACHABLE TO IMAGE FORMING APPARATUS

(75) Inventor: Minoru Matsuguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/322,712

(22) Filed: Dec. 19, 2002

(65) Prior Publication Data

US 2003/0095805 A1 May 22, 2003

Related U.S. Application Data

(62) Division of application No. 10/041,590, filed on Jan. 10, 2002, now Pat. No. 6,549,733.

(30) Foreign Application Priority Data

Jan. 15, 2001 (JP) ..... 2001-006946

(51) Int. Cl.[7] ..... G03G 15/00

(52) U.S. Cl. ..... 399/26; 399/24; 399/25; 399/396

(58) Field of Search ..... 399/24, 25, 26, 399/396

(56) References Cited

U.S. PATENT DOCUMENTS

| | | | | |
|---|---|---|---|---|
| 4,851,960 A | | 7/1989 | Nakamura et al. | 361/225 |
| 5,278,612 A | | 1/1994 | Inui | |
| 5,420,671 A | | 5/1995 | Kisu et al. | |
| 5,426,488 A | | 6/1995 | Hayakawa et al. | |
| RE35,581 E | | 8/1997 | Nakamura et al. | 361/225 |
| 5,678,125 A | * | 10/1997 | Kutsuwada et al. | 399/26 |
| 5,887,222 A | * | 3/1999 | Sako | 399/51 |
| 5,907,739 A | | 5/1999 | Tsunemi et al. | |
| 6,112,036 A | * | 8/2000 | Shinohara | 399/24 |
| 6,427,054 B1 | | 7/2002 | Ohkubo et al. | |

FOREIGN PATENT DOCUMENTS

| | | |
|---|---|---|
| JP | 63-149669 | 6/1988 |
| JP | 1-267667 | 10/1989 |
| JP | 4-51259 | 2/1992 |
| JP | 4-98265 | 3/1992 |
| JP | 5-188674 | 7/1993 |
| JP | 5-333626 | 12/1993 |
| JP | 6-130732 | 5/1994 |
| JP | 6-180518 | 6/1994 |

* cited by examiner

*Primary Examiner*—Hoang Ngo
(74) *Attorney, Agent, or Firm*—Fitzpatrick, Cella, Harper & Scinto

(57) ABSTRACT

An image bearing member life detecting method capable of accurately detecting that the life of an image bearing member has expired or will expire soon, an image forming apparatus using the method, and a cartridge detachably attachable to the image forming apparatus, are provided. An image bearing member damage index number D representing the consumption degree of an image bearing member is calculated on the basis of an applying period under each condition of an electrostatic charge bias applied to an electrostatic charging portion for forming an electrostatic latent image on the image bearing member, and/or the contact period of a developing portion for developing the electrostatic latent image on the image bearing member. When the process speed is switched, the calculation method is switched in accordance with the process speed, and the image bearing member damage index number D is calculated. The image bearing member damage index number D is integrated and stored as an image bearing member damage integration value S. The image bearing member damage integration value S is compared with life information R corresponding to the image bearing member damage integration value S for a predetermined life of the image bearing member, thereby detecting the life of the image bearing member.

6 Claims, 8 Drawing Sheets

IMAGE FORMING APPARATUS, IMAGE BEARING MEMBER LIFE DETECTING METHOD, AND PROCESS CARTRIDGE DETACHABLY ATTACHABLE TO IMAGE FORMING APPARATUS

CROSS REFERENCE TO RELATED APPLICATION

This application is a divisional application of application Ser. No. 10/041,590, filed Jan. 10, 2002, now U.S. Pat. No. 6,549,733, issued Apr. 15, 2003.

BACKGROUND OF THE INVENTION

1. Field of the Invention

The present invention generally relates to an image forming apparatus for forming an electrostatic latent image on an electrophotographic photosensitive member by electrophotography and visualizing the electrophotographic latent image with a developer, an image bearing member life detecting method, and a process cartridge detachably attachable to the image forming apparatus.

The electrophotographic image forming apparatus includes, e.g., an electrophotographic copying machine, electrophotographic printer (e.g., LED printer or laser beam printer), and electrophotographic facsimile apparatus.

The cartridge detachably attachable to the main body of the electrophotographic image forming apparatus means a cartridge having at least one of an electrophotographic photosensitive member, an electrostatic charging means for electrostatically charging the electrophotographic photosensitive member, a developing means for supplying a developer to the electrophotographic photosensitive member, and a cleaning means for cleaning the electrophotographic photosensitive member. Among detachably attachable cartridges, a process cartridge is a cartridge which is an integral unit of an electrophotographic photosensitive member and at least one of an electrostatic charging means, developing means, and cleaning means, and is detachably attachable to the main body of an electrophotographic image forming apparatus, or which is an integral unit of at least a developing means and electrophotographic photosensitive member and is detachably attachable to the main body of an electrophotographic image forming apparatus.

2. Related Background Art

Conventionally, an electrophotographic image forming apparatus such as an electrophotographic copying machine or laser beam printer uniformly electrostatically charges an electrophotographic photosensitive member by using an electrostatic charging means, and irradiates the surface of the photosensitive member with light corresponding to image information to form a latent image. Then, the apparatus supplies a developer to the latent image by using a developing means to visualize the image, transfers the visualized image onto a recording medium, and fixes the image by a fixing apparatus to obtain the image. After transfer, the electrophotographic photosensitive member is cleaned by a cleaning means.

This image forming apparatus adopts a process cartridge method in order to facilitate replacement and maintenance of expendables such as an electrophotographic photosensitive member and developer. More specifically, an electrophotographic photosensitive member, a developing means, electrostatic charging means, and cleaning means as process means which act on the electrophotographic photosensitive member, a developer storage vessel, and a waste developer vessel are integrated into a cartridge. The cartridge is detachably attachable to the main body of the image forming apparatus.

According to the process cartridge method, the apparatus can be maintained not by the serviceman but by the user. For example, when the developer runs out or the life of the photosensitive drum has expired, the user can replace the cartridge with a new one and form an image again. This process cartridge method can significantly improve the operability of the apparatus, and is widely used in electrophotographic image forming apparatuses.

The process cartridge type image forming apparatus must warn the user that, e.g., the life of an expendable element such as an electrophotographic photosensitive member or developer has expired or will expire soon, and allows the user to replace the expendable element with a new one at arbitrary time.

The following conventional life detecting methods for a cylindrical electrophotographic photosensitive member, i.e., photosensitive drum, are available.

(1) The number of image forming sheets is integrated to detect the life of the photosensitive drum. According to the simplest method, each of image forming recording media of, e.g., different A4 and A3 sizes is counted as one sheet. In this case, however, the life of the photosensitive drum is detected with poor precision. Also when the number of image forming sheets is merely integrated, the life of the photosensitive drum is detected with poor precision because the rotation period of the photosensitive drum per recording medium changes depending on the number of image forming sheets per job, i.e., the successive number of recording media for forming an image after the start of image forming operation, and the life of the photosensitive drum (to be described later) changes depending on the rotation period.

(2) Japanese Patent Application Laid-Open No. 4-51259 discloses a conventional method of detecting the electrostatic charge amount of a photosensitive drum by a surface potential sensor. According to this method, a decrease in the electrostatic charge potential of the photosensitive drum or a decrease in latent image contrast can be actually detected directly by the surface potential sensor. Compared to method (1), the life can be detected with high precision while the output image state is reflected. Practicing this method, however, requires a surface potential sensor and an electrical circuit for processing an output from the sensor, resulting in high cost. As for the longitudinal direction of the photosensitive drum, determination is made based on only information on the photosensitive drum that corresponds to the sensor position. The detection ability is poor for a partial error, and the stability is low due to variations or changes over time in the surface potential sensor. The life of the photosensitive drum is not always accurately detected.

(3) As a method of solving the problems of method (1) and increasing the life detection precision for the photosensitive drum, Japanese Patent Application Laid-Open No. 5-188674 discloses a method of integrating not the number of image forming sheets but the number of turns of the photosensitive drum. Some methods integrate the rotation period of the photosensitive drum on the basis of the same principle. In any method, the number of turns (rotation period) is large for a large recording medium size in correspondence with the recording medium size in one image formation, and is small for a small recording medium size. A photosensitive drum life detection error by a difference in recording medium size is reduced in comparison with the case of integrating the number of image forming sheets.

Since the number of turns (rotation period) of the photosensitive drum is directly integrated regardless of the number of image forming sheets per job, the life detection precision is relatively high.

As a method developed from method (3), Japanese Patent Application Laid-Open No. 4-98265 discloses that the number of turns of the photosensitive drum is integrated in actual image formation by integrating the number of turns of the photosensitive drum only when a transferring charger as a transferring means operates, and that the life of the photosensitive drum can be more accurately detected. Japanese Patent Application Laid-Open No. 6-180518 discloses that the number of turns of the photosensitive drum while the photosensitive drum undergoes electrostatic charging processing, and the number of turns of the photosensitive drum while a cleaning member for cleaning the photosensitive drum is in contact with the photosensitive drum are respectively integrated, and the life of the photosensitive drum is determined based on the comparison with their set values (lives).

The following method is known as a method of notifying the user of the replacement timing of a process cartridge. According to a method disclosed in Japanese Patent Application Laid-Open No. 5-333626, the user is notified of the replacement timing of a process cartridge constituted by a cleaner (cleaning means) and electrophotographic photosensitive member on the basis of the life of the electrophotographic photosensitive member. The number of image forming sheets is integrated, and when the assured life of the electrophotographic photosensitive member has expired, the apparatus stops and cannot be used. As replacement display operation based on the life of the electrophotographic photosensitive member, the user is reminded to prepare for a replacement cartridge by the end of the assured life by displaying that the replacement time is coming soon, and if the cartridge is kept used, the user is warned that the apparatus will stop soon.

This prior art also enables notifying the user of the replacement timing of the cartridge on the basis of the toner amount in the recovery toner storage portion of the cleaner. More specifically, the ON period of a toner replenishment driving motor is integrated, and the apparatus stops at the earliest integration time at which conditions are supposed to become worse in consideration of variations. Also in this case, as replacement display operation based on the amount in the toner storage portion, a display which reminds the user to replace a cartridge is performed when the integration ON period of the toner replenishment driving motor reaches a given value until the apparatus stops, or a display which notifies the user that the apparatus will stop soon is performed at advanced integration time.

According to this prior art, the operation based on the life of the electrophotographic photosensitive member and the operation based on the toner amount in the recovery toner storage portion of the cleaner are generally so set as to give priority to the number of prints, i.e., the life of the electrophotographic photosensitive member. However, the operation based on the toner amount in the recovery toner vessel functions when toner replenishment is frequently done because of an extremely high image density and the recovery toner vessel will become full earlier than the assured life (assured number of sheets) of the electrophotographic photosensitive member.

In the technique disclosed in Japanese Patent Application Laid-Open No. 5-333626, the process cartridge comprises a storage means. The total energization period of the primary charger of the image forming apparatus is written at once in the storage means by a CPU in the image forming apparatus. The subsequent energization period of the primary charger is written and saved. The storage means of the spent process cartridge is recovered and analyzed to accurately determine the total amount of a use variable, such as the current number of turns of the photosensitive drum or the discharge period of the corotron in the image forming apparatus which uses the spent process cartridge. Information of the image forming apparatus can be collected at a process cartridge replacement interval. More specifically, the number of operation cycles of the photosensitive drum, the replacement time of an ozone filter, and wear data prediction of the photosensitive drum in the image forming apparatus can be determined in replacing a process cartridge.

According to the technique disclosed in this reference, the life of the photosensitive drum is determined based on the number of image forming sheets. The life prediction precision for the photosensitive drum on the basis of the number of image forming sheets is low, as described above.

Recently, some developing apparatuses for developing a latent image formed on an electrophotographic photosensitive member use a so-called single-component developer containing toner as substantially a single main component. The single-component developing type developing apparatus need not control mixing and agitation of toner and carrier and the toner density (ratio of the toner to the total amount of toner and carrier), unlike a so-called two-component developer type developing apparatus using carrier and toner particles as main components that has conventionally been popular. The single-component developing type developing apparatus achieves a small size and low cost, eliminates any developer replacement operation, and is very effective in a printer demanding a maintenance free operation. A non-magnetic toner used as the toner of the single-component developer can realize a smaller size and lower cost because no magnet roll need be attached to a developer carrying member for carrying a developer to an electrophotographic photosensitive member.

The single-component developing type developing apparatus comprises a developer vessel (hopper) for storing a single-component developer (toner), a developer carrying member (developing roller) implemented as, e.g., a roller which is arranged adjacent to the developer vessel and carries the toner to a latent image on the electrophotographic photosensitive member, a toner supply roller which is brought into contact with the developing roller and rotates in the same direction as the developing roller, and a developer layer thickness regulation means (regulation blade) implemented as, e.g., a blade for regulating the toner amount carried on the developing roller. The toner supply roller carries the toner in the hopper to the developing roller, and the regulation blade forms a thin toner layer on the developing roller. The thin toner layer is brought into contact with the electrophotographic photosensitive member to develop an electrostatic latent image formed on the electrophotographic photosensitive member. Such an apparatus is known as a so-called contact single-component developing type developing apparatus.

When a non-magnetic toner is used as the toner of a single-component developer, the regulation blade such as an elastic blade is brought into contact with the developing roller, and a thin toner layer is formed on the developing roller by using the electric charges of the toner or the Coulomb force by frictional electrostatic charge. In this manner, the toner is supplied and carried.

In recent years, contact electrostatic charging apparatuses have widely been used as an electrostatic charging apparatus for electrostatically charging an electrophotographic photosensitive member, instead of conventionally widely used corona electrostatic charging apparatuses. The contact electrostatic charging apparatus requires a lower application bias than the corona electrostatic charging apparatus, hardly produces ozone, uses a smaller number of building components of the electrostatic charging apparatus, and can reduce the cost.

Such contact electrostatic charging apparatuses are roughly classified into two, brush and roller electrostatic charging apparatuses in accordance with the form of an electrostatic charging member used. The brush electrostatic charging apparatus suffers brush marks and inclination of bristles upon long-term abutment to the electrophotographic photosensitive member. The roller electrostatic charging apparatus has difficult problems: the roller resistance must be adjusted to obtain uniform electrostatic charge, drum contamination by bleed from rubber which forms the roller must be prevented, strict constraints are posed on the roller shape and surface property in order to obtain uniform electrostatic charge.

A voltage applied to the above-described contact electrostatic charging member is only a DC bias (to be referred to as "DC electrostatic charge" hereinafter) or an AC bias superimposed on a DC bias (to be referred to as "AC electrostatic charge" hereinafter). In general, AC electrostatic charge can realize uniform electrostatic charge in comparison with DC electrostatic charge.

In AC electrostatic charge, a DC voltage is superimposed as an application bias on an AC voltage twice or more the discharge start voltage by using a roller-shaped electrostatic charging member (electrostatic charging roller) as an electrostatic charging member (Japanese Patent Application Laid-Open Nos. 63-149669 and 1-267667). Alternatively, a DC voltage is superimposed as an application bias on an AC voltage twice or less than discharge start voltage by using a conductive brush as an electrostatic charging member (Japanese Patent Application Laid-Open No. 6-130732).

The above-described contact electrostatic charging method rarely produces ozone, requires a smaller number of building components of the electrostatic charging apparatus, and can provide a low-cost electrostatic charging apparatus. However, contact electrostatic charge greatly damages the electrophotographic photosensitive member, compared to corona electrostatic charge. This trend is prominent particularly in the use of an OPC photosensitive drum.

Even in the same contact electrostatic charge method, the damage to the electrophotographic photosensitive member changes depending on the application voltage to the electrostatic charging member. The damage to the electrophotographic photosensitive member is larger for a higher application voltage. Also when only a DC voltage is applied as an electrostatic charge bias, the damage increases in comparison with the case of rotating the photosensitive drum without applying any electrostatic charge bias. If an AC voltage is superimposed and applied as an electrostatic charge bias, the damage (particularly the shaving amount of the OPC photosensitive drum) further increases to about several times that in the case of applying only a DC voltage as an electrostatic charge bias.

Especially application of an AC voltage twice or more the discharge start voltage significantly increases the damage to the electrophotographic photosensitive member. Even at an AC voltage twice or less the discharge start voltage, the damage is large about several times that in application of only a DC voltage.

A higher frequency of an AC voltage applied as an electrostatic charge bias also tends to increase the damage to the electrophotographic photosensitive member (particularly the OPC photosensitive drum).

As described above, in recent years, a single-component developer is carried by a developing roller serving as a developer carrying member, and brought into contact with a photosensitive drum to develop an electrostatic latent image on the photosensitive drum. Contact rotation of the developing roller also shaves the photosensitive drum.

Generally, in the use of a single-component non-magnetic developing apparatus in which the developing roller comes into contact with the photosensitive drum, the peripheral speed of the developing roller is set higher than that of the photosensitive drum in order to ensure a necessary density. In particular, a developing roller having a relative peripheral speed ratio to the photosensitive drum tends to increase the damage to the photosensitive drum.

However, the rotation period of the photosensitive drum and the contact period between the photosensitive drum and the developing roller are not proportional to each other in a color image forming apparatus for switching developing apparatuses of a plurality of colors and developing an electrostatic latent image on a photosensitive drum, or an image forming apparatus which adopts a method of arranging a contact/separation mechanism for separating a developing roller from a photosensitive drum and of separating the developing apparatus from the photosensitive drum during rotation of the photosensitive drum in a non-image forming period in order to prevent any fog in contact developing.

As is apparent from the above description, the damage to the photosensitive drum changes depending on electrostatic charge conditions in an image forming apparatus having an electrostatic charging means for electrostatically charging the photosensitive drum by, e.g., contact electrostatic charge under a plurality of electrostatic charge conditions during image formation. The life of the photosensitive drum is difficult to accurately predict by a conventional method of detecting the life of the photosensitive drum simply by the number of turns of the photosensitive drum.

Also in the use of a developing apparatus which can be brought into contact with or separated from the photosensitive drum, the rotation period of the photosensitive drum and the contact period between the photosensitive drum and the developing roller are not proportional to each other. Thus, the life of the photosensitive drum cannot be accurately detected by a conventional method of detecting the life of the photosensitive drum simply from the number of turns of the photosensitive drum.

When, for example, the resolution is switched to high one with several process speeds, an image is formed by decreasing the process speed without changing the rotational speed of an exposing apparatus using a polygon mirror, or an image is reliably fixed by decreasing the process speed in order to thermally fix the toner on a thick sheet or the like.

In this manner, in an image forming apparatus having a process speed switching mode, the damage to the photosensitive drum changes upon a change in speed. Hence, the accurate life of the photosensitive drum cannot be detected.

A cartridge replacement warning may fail though the life of the photosensitive drum has expired and an image error occurs due to the above reasons. Alternatively, a cartridge replacement warning may be issued though the life of the photosensitive drum does not expire.

SUMMARY OF THE INVENTION

It is a principal object of the present invention to provide an image forming apparatus capable of accurately detecting that the life of an image bearing member has expired or will expire soon, an image bearing member life detecting method, and a cartridge detachably attachable to the image forming apparatus.

It is another object of the present invention to provide an image forming apparatus capable of accurately notifying the user that the replacement time has come or is coming soon on the basis of the life of the image bearing member, an image bearing member life detecting method, and a cartridge detachably attachable to the image forming apparatus.

It is still another object of the present invention to provide an image forming apparatus capable of accurately detecting that the image bearing member has expired or will expire soon particularly when an image is formed at a plurality of process speeds, the image bearing member is electrostatically charged under a plurality of electrostatic charge conditions, or the developing means can be separated from or brought into contact with the image bearing member, an image bearing member life detecting method, and a cartridge detachably attachable to the image forming apparatus.

The above and other objects, features, and advantages of the present invention will be apparent from the following description in conjunction with the accompanying drawings.

DESCRIPTION OF THE PREFERRED EMBODIMENTS

An image bearing member life detecting method, an image forming apparatus, and a process cartridge according to the present invention will be described in detail below with reference to the accompanying drawings.

Figure 1:
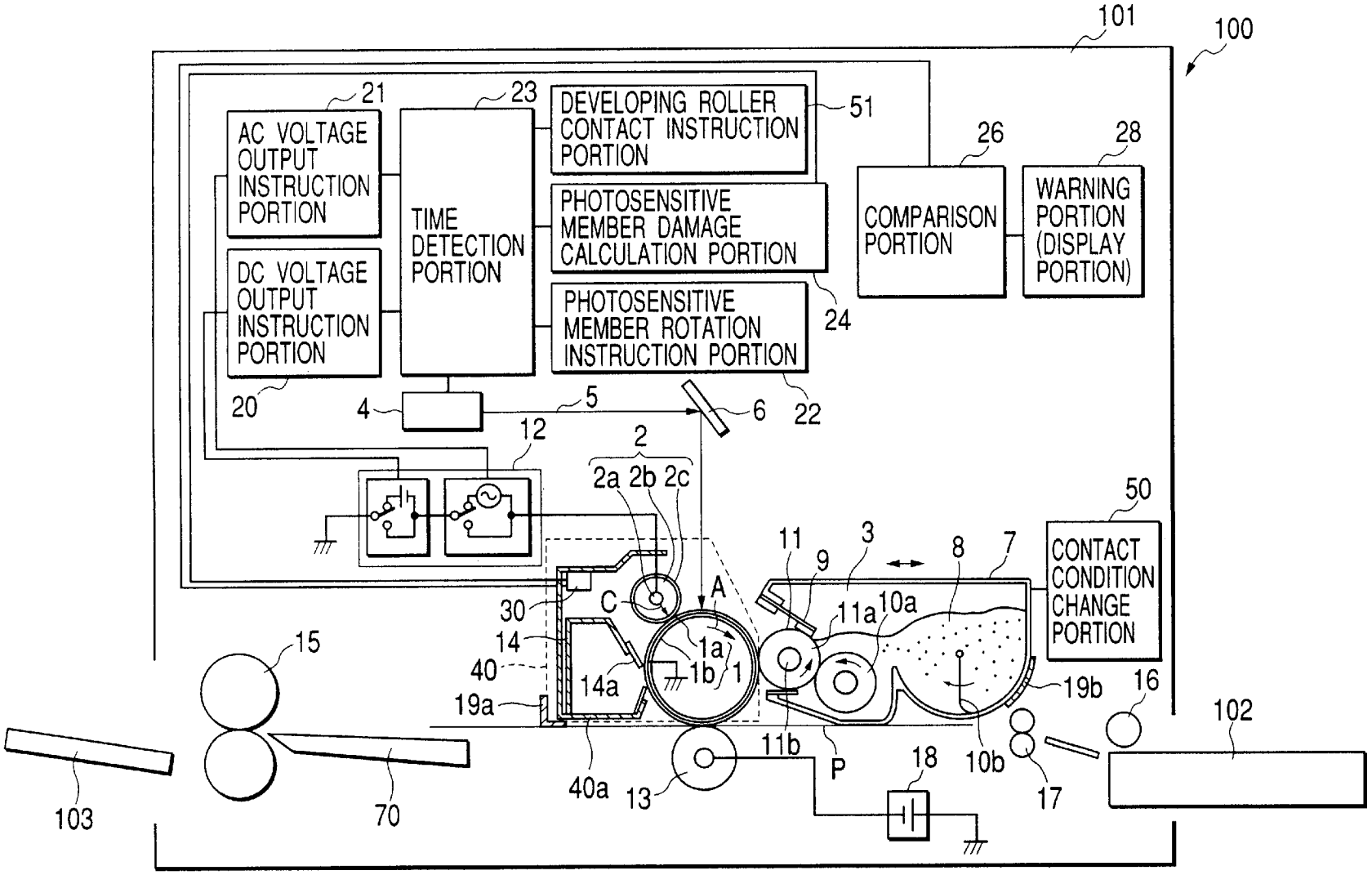
FIG. 1 is a schematic block diagram showing an image forming apparatus in an embodiment.
Figure 2:
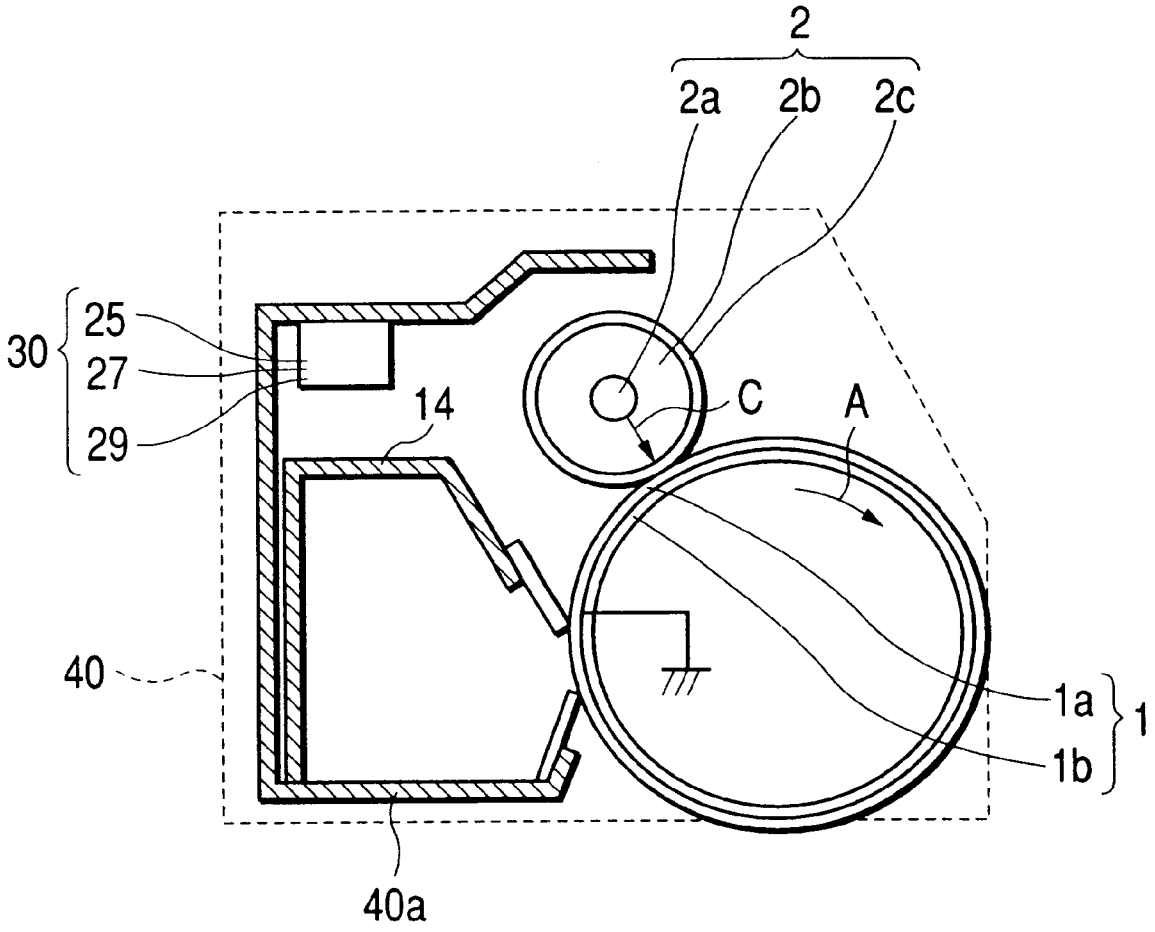
FIG. 2 is a schematic view showing a cartridge detachably attachable to the image forming apparatus.

An image forming apparatus according to this embodiment of the present invention will be described with reference to FIGS. 1 and 2. FIG. 1 is a schematic block diagram showing the image forming apparatus in this embodiment. The image forming apparatus in this embodiment is an electrophotographic printer, and particularly a laser beam printer (LBP) 100 for performing exposure using a laser beam.

As shown in FIG. 1, the printer 100 of this embodiment comprises a cylindrical electrophotographic photosensitive member (photosensitive member), i.e., photosensitive drum 1 as an image bearing member. The photosensitive drum 1 has an outer diameter of 30 mm, is constituted by stacking a photoconductive photosensitive layer 1*a* on the surface of an aluminum conductive base 1*b*, and is rotated and driven in a direction indicated by an arrow A in FIG. 1. In this embodiment, the photosensitive drum 1 is an OPC photosensitive drum having the photosensitive layer 1*a* using a polycarbonate resin as a main binder.

The photosensitive drum 1 is uniformly negatively charged (primary electrostatic charge) by an electrostatic charging roller 2 serving as an electrostatic charging means. A laser scanner 4 disposed as an optical system emits a laser beam 5 in correspondence with time-series electrical digital image signals of image information sent from a video controller (not shown). The laser beam 5 scans and exposes the photosensitive drum 1 via a mirror 6. As a result, an electrostatic latent image is formed on the surface of the photosensitive drum 1.

The printer 100 of this embodiment can form an image at 600 dpi and 1,200 dpi. In a general printer, the resolution is 600 dpi, and the peripheral speed of rotation/driving of the photosensitive drum is 100 mm/sec. In a high-resolution printer, the resolution is 1,200 dpi, and the peripheral speed of rotation/driving of the photosensitive drum is 50 mm/sec. This realizes high resolution without changing the scan speed of the exposure means. In this embodiment, the speed of the image forming process is represented by the peripheral speed of the photosensitive drum. The process speed is V1 for 600 dpi and V2 for 1,200 dpi. That is, V1=100 mm/sec, and V2=50 mm/sec.

The electrostatic latent image on the photosensitive drum 1 is reversely developed by a developer 8 carried on a developing roller 11 serving as a developer carrying member on a developing apparatus 7. The latent image is visualized as a toner image.

A recording medium P is fed from a recording medium cassette 102 serving as a recording medium storage means into an apparatus main body 101 by a pickup roller 16 or the like. The recording medium P is conveyed to registration rollers 17. The registration rollers 17 feed the recording medium P to a transferring portion where the photosensitive drum 1 faces a transferring roller 13 serving as a transferring means so as to establish synchronization with formation of the toner image on the photosensitive drum 1.

The toner image formed on the photosensitive drum 1 is electrostatically transferred onto the recording medium P by the transferring roller 13. The recording medium P on which the toner image is transferred is separated from the photosensitive drum 1, and guided to a fixing apparatus 15 via a convey means 70 where the toner image is fixed. After that, the recording medium P is discharged from the image forming apparatus main body 101, and stacked on a sheet discharge tray 103. In the photosensitive drum 1 after the transfer step, a developer which is not transferred and remains on the photosensitive drum 1, i.e., a so-called residual toner is cleaned by a cleaning apparatus 14. Then, the photosensitive drum 1 is electrostatically charged again. In this embodiment, the cleaning apparatus 14 has as a cleaning means a blade cleaning member 14*a* which comes into contact with the photosensitive drum 1 and scrapes the residual toner.

In this embodiment, the photosensitive drum 1, electrostatic charging roller 2, and cleaning apparatus 14 are integrated by a frame (vessel) 40*a* into a drum unit (process cartridge) 40 detachably attachable to the apparatus main body 101. The developing apparatus 7 separately functions as a developing unit detachably attachable to the apparatus main body 101. The drum unit 40 and developing unit are detachably supported by the apparatus main body 101 via mounting means 19*a* and 19*b*.

The drum unit 40 incorporates a storage device 30. As shown in FIG. 2, the storage device 30 comprises a photosensitive member damage integration storage portion 25, photosensitive member life information storage portion 27, and photosensitive member damage calculation coefficient storage portion 29 (to be described in detail later). The storage element can be freely selected from general semiconductor electronic memories such as a nonvolatile memory or a combination of a nonvolatile memory and backup battery.

The vessel 40*a* of the drum unit 40 has a connection terminal (not shown) so as to communicate with the control portion of the apparatus main body 101 upon mounting on the image forming apparatus.

The developing apparatus (developing unit) 7 will be explained in detail. The developing apparatus 7 used in this embodiment employs a contact developing method. The developing apparatus 7 comprises the developing roller 11 serving as a developer carrying member which is pivotally supported and carries the developer 8 to the photosensitive drum 1, a supply roller 10*a* which rotates in a counter direction in contact with the developing roller 11 and supplies the developer 8, a developer storage chamber 3, and an agitating means 10*b* for agitating and carrying the developer and supplying the developer 8 toward the supply roller 10*a*. The developing apparatus 7 is supported by the apparatus main body 101 such that the developing roller 11 can be brought into contact with and separated from the photosensitive drum 1. Contact/separation of the developing roller 11 to/from the photosensitive drum 1 is changed by a contact condition change portion 50.

Figure 3A:
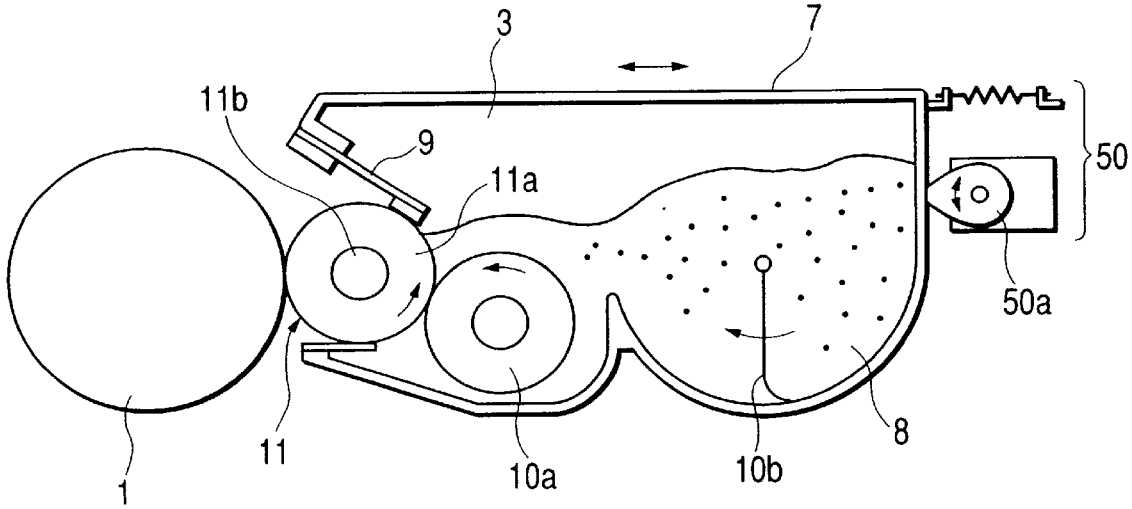
FIGS. 3A and 3B are views showing an example of a contact condition change portion 50 of a developing roller 11.
Figure 3B:
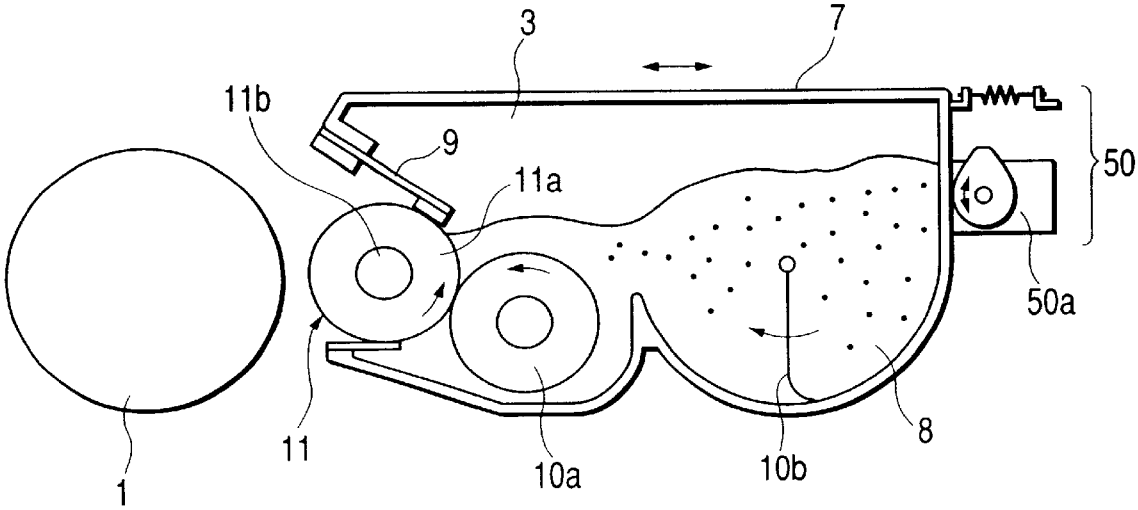

FIGS. 3A and 3B are views showing an example of the contact condition change portion 50 of the developing roller 11. A cam member 50*a* of the contact condition change portion 50 according to this embodiment is in contact with part of the developing apparatus 7. The cam member 50*a* rotates to horizontally slide the developing apparatus 7, thereby changing contact/separation of the developing roller 11 to/from the photosensitive drum 1. FIG. 3A shows the contact state, and FIG. 3B shows the separation state.

The developing roller 11 is constituted by forming a conductive elastic layer 11*a* on a core metal 11*b*. The developing roller 11 is generally driven with respect to the photosensitive drum 1 at a peripheral speed ratio of 100% to 200% (equal in speed to the photosensitive drum 1 for a peripheral speed ratio of 100%) in accordance with the developing characteristic of the developer. When an application bias of −500 V is supplied, the developer 8 applied to a thin layer on the developing roller 11 by an elastic blade 9 serving as a developer layer thickness regulation member is transferred to an electrostatic latent image on the photosensitive drum 1 at a position where the developing roller 11 faces the photosensitive drum 1.

This embodiment uses a non-magnetic single-component toner (toner) as the developer 8, which is stored in the developer storage chamber 3.

The electrostatic charging roller 2 as a contact electrostatic charging means will be explained in detail. The electrostatic charging roller 2 shown in FIG. 1 has a two-layered structure prepared by winding a sponge layer 2*b* and surface layer 2*c* on a core metal 2*a* (sponge electrostatic charging roller). The core metal 2*a* has a diameter of 6 mm, an outer roller diameter of 12 mm, and a roller length of about 220 mm. A pressure of 500 gf (∞4.9 N) is applied to the two longitudinal ends of the core metal 2*a* each in a direction indicated by an arrow C in FIG. 1. The electrostatic charging roller 2 is in contact with the photosensitive drum 1 at a nip of about 1.5 mm. The electrostatic charging roller 2 is not driven, and rotates following the photosensitive drum 1.

The electrostatic charging roller 2 is connected to an electrostatic charge bias application power supply 12 via the core metal 2*a*. In this embodiment, a bias obtained by superimposing a DC bias of −700 V on an AC bias (peak voltage: 1,600 V, frequency: 1,000 Hz, sine wave) is applied as an electrostatic charge bias applying condition A to part of the rotating photosensitive drum 1 including an image forming region, thereby uniformly electrostatically charging the surface of the photosensitive drum 1 to about −680 V (AC electrostatic charge), like an image forming operation sequence shown in FIG. 4. Further, the remaining portion of the rotating photosensitive drum 1 includes a portion where only −1,250 V is applied as an electrostatic charge bias applying condition B to electrostatically charge the surface of the photosensitive drum 1 to about −680 V (DC electrostatic charge), and a portion where no electrostatic charge bias is applied as an electrostatic charge bias applying condition C.

In this embodiment, the electrostatic charge bias applying condition is switched between the following conditions in accordance with the purpose:

Electrostatic charge bias applying condition A (AC electrostatic charge): a bias prepared by superimposing a DC bias on an AC bias is used to obtain a uniform, high-quality image in an image region, or to remove a surface potential at the end of image formation.

Electrostatic charge bias applying condition B (DC electrostatic charge): a uniform surface potential is not particularly required, but a predetermined surface potential is required to prevent unnecessary spray of a developer from the developing apparatus 7, i.e., unnecessary developing operation and to clean the transferring roller 13. Only a DC bias which hardly damages the photosensitive drum 1 is used.

Electrostatic charge bias applying condition C: a predetermined surface potential is not particularly required, so no electrostatic charge bias is applied.

It is also effective to decrease the voltage value (or current value) of an AC bias or decrease the frequency.

A life detecting method of detecting the life of the photosensitive drum 1 will be described as a characteristic feature of the present invention.

As shown in FIG. 1, rotation of the photosensitive drum 1 is controlled by a photosensitive member rotation instruction portion 22. AC and DC biases are independently controlled by AC and DC voltage output instruction portions 21 and 20, and properly applied from the electrostatic charge bias application power supply 12 to the electrostatic charging roller 2 as a contact electrostatic charging member.

The contact condition change portion 50 is controlled by the developing roller contact instruction portion 51 to switch movement of the developing apparatus 7, i.e., contact/separation of the developing roller 11 to/from the photosensitive drum 1.

The AC voltage output instruction portion 21, DC voltage output instruction portion 20, and photosensitive member rotation instruction portion 22 are coupled to a time detection portion 23. The time detection portion 23 detects applying periods t1, t2, and t3 in each electrostatic charge bias applying condition during one job of image forming operation. These applying periods will be described in detail below. The developing roller contact instruction portion 51 is also coupled to the time detection portion 23. The time detection portion 23 detects a period (developing roller contact period) td during which the developing roller 11 is in contact with the photosensitive drum 1 during one job of image forming operation.

Figure 4:
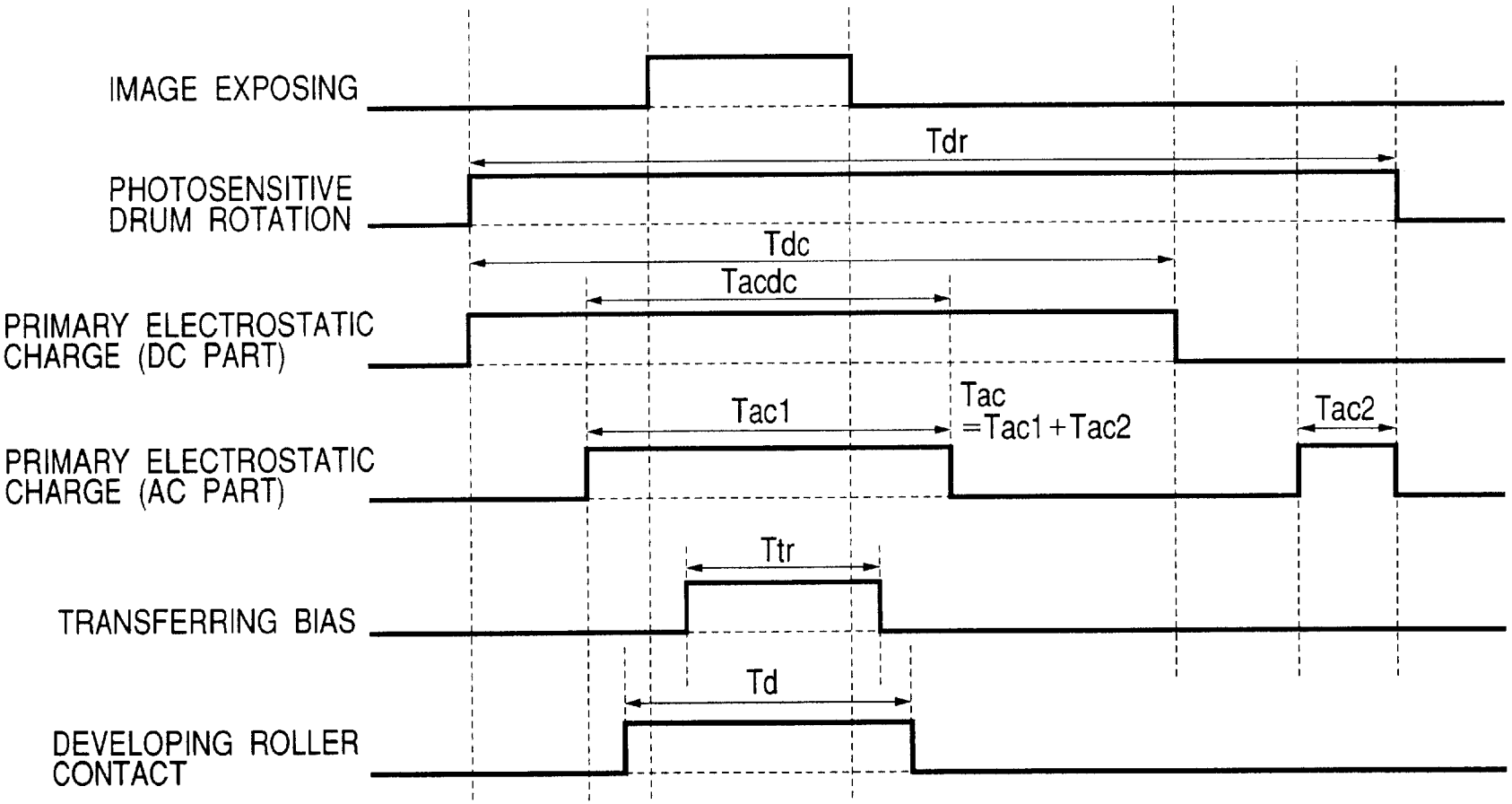
FIG. 4 is a timing chart showing an image forming operation sequence.

Like the image forming operation sequence shown in FIG. 4, the applying period t1 is obtained as applying period information Tac (t1=Tac1+Tac2) from the AC voltage output instruction portion 21. t2 is calculated by subtracting an AC voltage superimposition period Tacdc from applying period information Tdc sent from the DC voltage output instruction portion 20 (t2=Tdc−Tacdc) t3 is calculated by subtracting t1 and t2 from photosensitive member rotation period information Tdr sent from the photosensitive member rotation instruction portion 22 (t3=Tdr−(t1+t2)). In other words, t3 is obtained as a period during which the electrostatic charge bias is OFF or the photosensitive drum 1 rotates at 0 V.

FIRST EMBODIMENT

A life detecting method of detecting the life of a photosensitive drum 1 in the first embodiment will be described.

Figure 5:
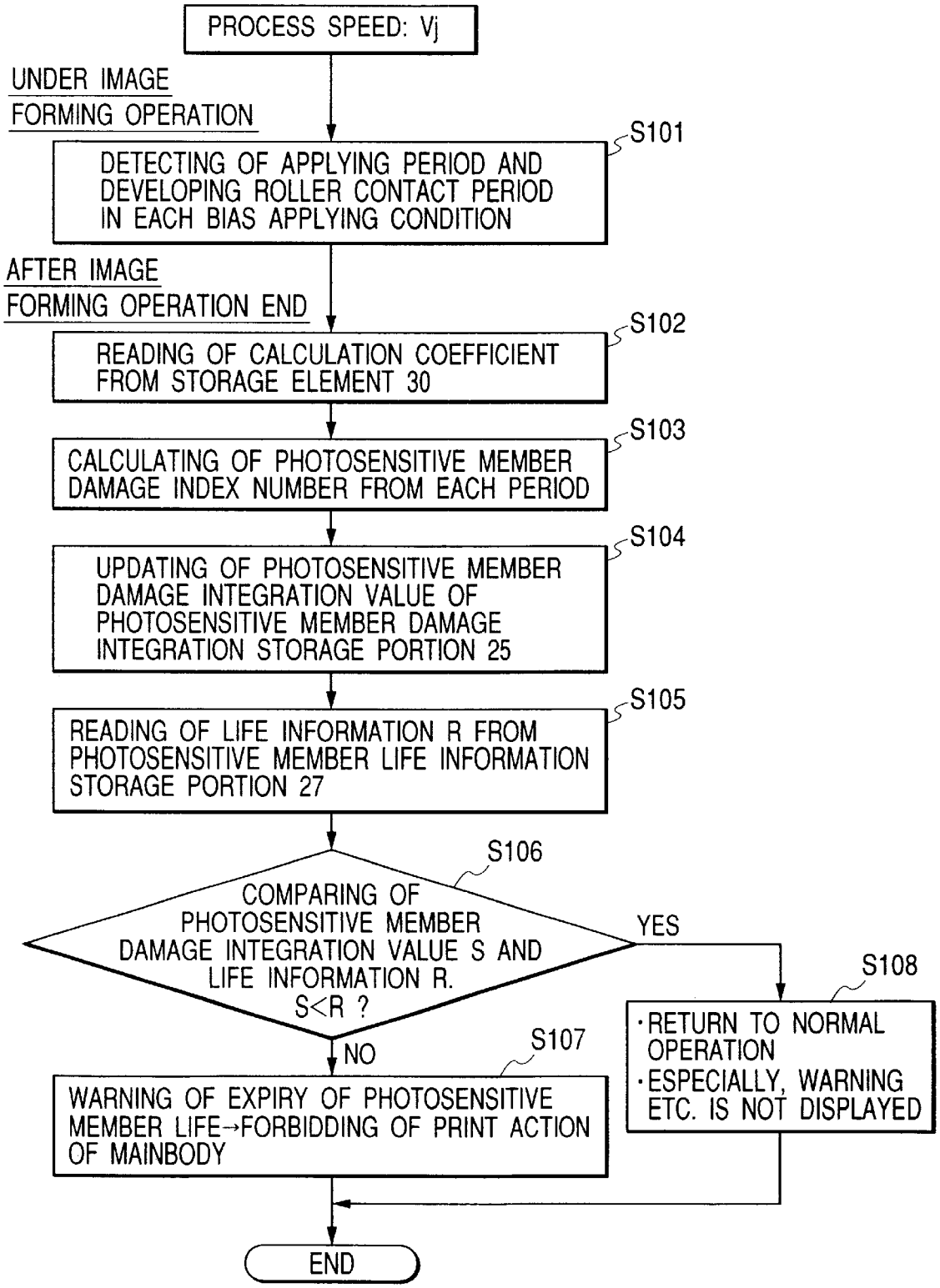
FIG. 5 is a flow chart showing a life detecting method in the first embodiment.

FIG. 5 is a flow chart showing the life detecting method in the first embodiment. During one job of image forming operation, a time detection portion 23 detects applying periods t1, t2, and t3 under each electrostatic charge bias applying condition, and a period td during which a developing roller 11 is in contact with the photosensitive drum 1 (step S101).

After one job of image forming operation ends, photosensitive member damage calculation coefficients k1j, k2j, k3j, and kdj stored in a photosensitive member damage calculation coefficient storage portion 29 of a storage device 30 in a drum unit 40 are sent to a photosensitive member damage calculation portion 24 in correspondence with the applying periods t1, t2, and t3, the developing roller contact period td, and a process speed Vj under each electrostatic charge bias applying condition (step S102). The photosensitive member damage calculation portion 24 is coupled to the storage device 30 in the drum unit 40 while the drum unit 40 is mounted in an apparatus main body 101.

The photosensitive member damage calculation portion 24 calculates a photosensitive member damage index number D from equation (1) (step S103):

$$D=k1j\times t1+k2j\times t2+k3j\times t3+kdj\times td \quad (1)$$

The photosensitive member damage calculation portion 24 reads a photosensitive member damage integration value S stored in a photosensitive member damage integration storage portion 25 of the storage device 30 for each job of image forming operation, and adds the obtained photosensitive member damage index number D to the photosensitive member damage integration value S to update the photosensitive member damage integration value S (Snew=Sold+D) (step S104). This operation is repeated every job of image forming operation.

After one job of image forming operation ends and updating of the photosensitive member damage integration value S stored in the storage device 30 of the drum unit 40 ends, a comparison portion 26 reads preset life information R from a photosensitive member life information storage portion 27 of the storage device 30 in the drum unit 40 (step S105), reads the updated integration value S from the photosensitive member damage integration storage portion 25 of the storage device 30, and compares the life information R with the updated photosensitive member damage integration value S (step S106).

If the updated integration value S is equal to or larger than the life information R as a result of comparison in step S106 (S≧R), a signal is sent to a photosensitive member life warning portion (display portion) 28 serving as a notifying means to warn the user or display that the life of the photosensitive drum 1 has expired. Image forming operation is forbidden (step S107).

If the photosensitive member damage integration value S is smaller than the life information R as a result of comparison in step S106 (S<R), the flow returns to normal operation without especially performing any warning or display (step S108).

Damage to the photosensitive drum 1 will be described in detail. The rotation period (Tdr) of the photosensitive drum 1, the DC bias applying period (Tdc), the AC bias applying period (Tac), and the developing roller contact period (Td) are different from each other, as shown in the sequence of FIG. 4.

The present inventors gave attention to and have made extensive studies for damage to the photosensitive drum 1, particularly shaving of the photosensitive drum 1 (drum shaving) in each state during an image forming operation sequence to find a great difference in drum shaving such that, letting "1" be drum shaving when no bias is applied while the developing roller 11 is in contact with the photosensitive drum 1, drum shaving upon application of a DC bias is "2" to "3", drum shaving upon application of an AC bias is "8" to "10", and drum shaving upon application of DC and AC biases while the developing roller 11 is separated from the photosensitive drum 1 is "6" to "8".

It is also confirmed that the shaving amount changes depending on the difference in process speed for the same period. For example, letting "1" be the shaving amount at a process speed V1 under the electrostatic charge bias applying condition B, the shaving amount is about "0.5" at a process speed V2.

This result is obtained by examination in a system which uses as a photosensitive member an OPC photosensitive member having a surface layer with a polycarbonate resin as a main binder and uses a blade cleaning member as a photosensitive member cleaning means.

In general, the life of the photosensitive drum 1 is mainly determined by drum shaving from the above examination result. When a plurality of electrostatic charge bias applying conditions exist, an applying period for each electrostatic charge bias applying condition is multiplied by predetermined coefficients corresponding to respective process speeds, and the products are added. Then, the drum shaving amount by application of electrostatic charge biases can be estimated to determine the life of the photosensitive drum 1.

As is apparent from the above examination, the drum shaving amount changes between the contact and separation states of the developing roller 11. The drum shaving amount is larger in the state in which the developing roller 11 is in contact with the photosensitive drum. When the contact or separation state of the developing roller 11 with respect to the photosensitive drum 1 is switched, the period during which the developing roller 11 is in contact with the photosensitive drum 1 is multiplied by a predetermined coefficient. Then, the drum shaving amount by contact of the developing roller 11 can be estimated to determine the life of the photosensitive drum 1.

More specifically, the photosensitive member damage index number D is calculated by a general formula for a process speed Vj, integrated as the photosensitive member damage integration value S, and used to estimate the drum shaving amount. This enables high-precision life detection (note that k1j>0, kij (i=2 to n)≧0, kdj≧0).

$$\sum_{i=1}^{n}(k_{ij}t_i) + k_{dj}t_d$$

As described above, in the first embodiment, the time detection portion 23 detects the applying periods t1, t2, and t3 and the developing roller contact period td under each electrostatic charge bias applying condition during one job of image forming operation. The photosensitive member damage calculation portion 24 calculates the photosensitive member damage index number D by using equation (1) based on a general formula and using coefficients (photosensitive member damage calculation coefficients k1j, k2j, k3j, and kdj) set in advance in accordance with the process speed Vj for the image forming apparatus of the first embodiment. The photosensitive member damage integration value S is updated by the latest integration value, thereby estimating the drum shaving amount of the photosensitive drum 1 and detecting the accurate life of the photosensitive drum 1.

According to the first embodiment, the storage device 30 is arranged in the drum unit 40. This can facilitate determination of the drum unit because the stored photosensitive member damage integration value S changes for each drum unit. Even if the user erroneously mounts an old drum unit in replacement with a new one, the drum unit can be determined without especially arranging any identifying means. A replacement error by the user can be prevented, and problems such as output of a defective image by erroneously using a drum unit whose life has expired can also be prevented.

In addition, the information R about the life of the photosensitive drum 1 is stored in advance in the storage device 30 of the drum unit 40. Even if the user mounts a drum unit having a different set life, the life of the drum unit can be properly detected in accordance with the set life of each drum unit, and a warning can be issued.

The photosensitive member damage calculation coefficients k1j, k2j, k3j, and kdj can be changed for each photosensitive drum or each lot of the photosensitive drum. More appropriate life detection can be realized in correspondence with the characteristics of the photosensitive member material.

The first embodiment adopts the sponge electrostatic charging roller as a contact electrostatic charging member, but the present invention is not limited to this. The contact electrostatic charging member may be a solid rubber roller. Further, the contact electrostatic charging member is not limited to a roller shape, and may have a blade shape, brush shape, brush roller shape, or the like.

Particularly when the photosensitive drum 1 is not greatly shaved in the image forming operation sequence, e.g., when the calculation coefficient ki is much smaller than k1 or the applying period ti is much smaller than t1, the term of the bias applying condition may be omitted as far as the necessary precision is ensured.

The photosensitive member damage calculation coefficients k1, k2, k3, and kd stored in the storage device 30 are input to the photosensitive member damage calculation portion 24 for each image forming job. Alternatively, these coefficients k1, k2, k3, and kd can be input once only when the apparatus main body 101 is powered on.

As described above, according to the first embodiment, the expiration of the life of the photosensitive drum 1, i.e., the expiration of the electrophotographic life can be accurately detected. The user can be accurately notified of the replacement time based on the life of the photosensitive drum 1. The photosensitive drum 1 can always be used in a good condition, and a high-quality image can always be attained.

SECOND EMBODIMENT

The second embodiment according to the present invention will be described in detail with reference to the accompanying drawings.

An image forming apparatus in the second embodiment is basically the same in arrangement as an image forming apparatus in the first embodiment shown in FIG. 1, and a description thereof will be omitted.

A life detecting method of detecting the life of a photosensitive drum 1 in the second embodiment will be described.

The second embodiment sets two pieces of information for determining the life of the photosensitive drum 1. More specifically, in the second embodiment, a storage device 30 in a drum unit 40 incorporates a photosensitive member life information storage portion 27. The photosensitive member life information storage portion 27 stores two pieces of information: warning information Y for reminding the user to prepare for replacement when the life of the photosensitive drum 1 will expire soon, and actual photosensitive member life information R. The warning information Y and photosensitive member life information R have a relation: warning information Y<photosensitive member life information R.

Figure 6:
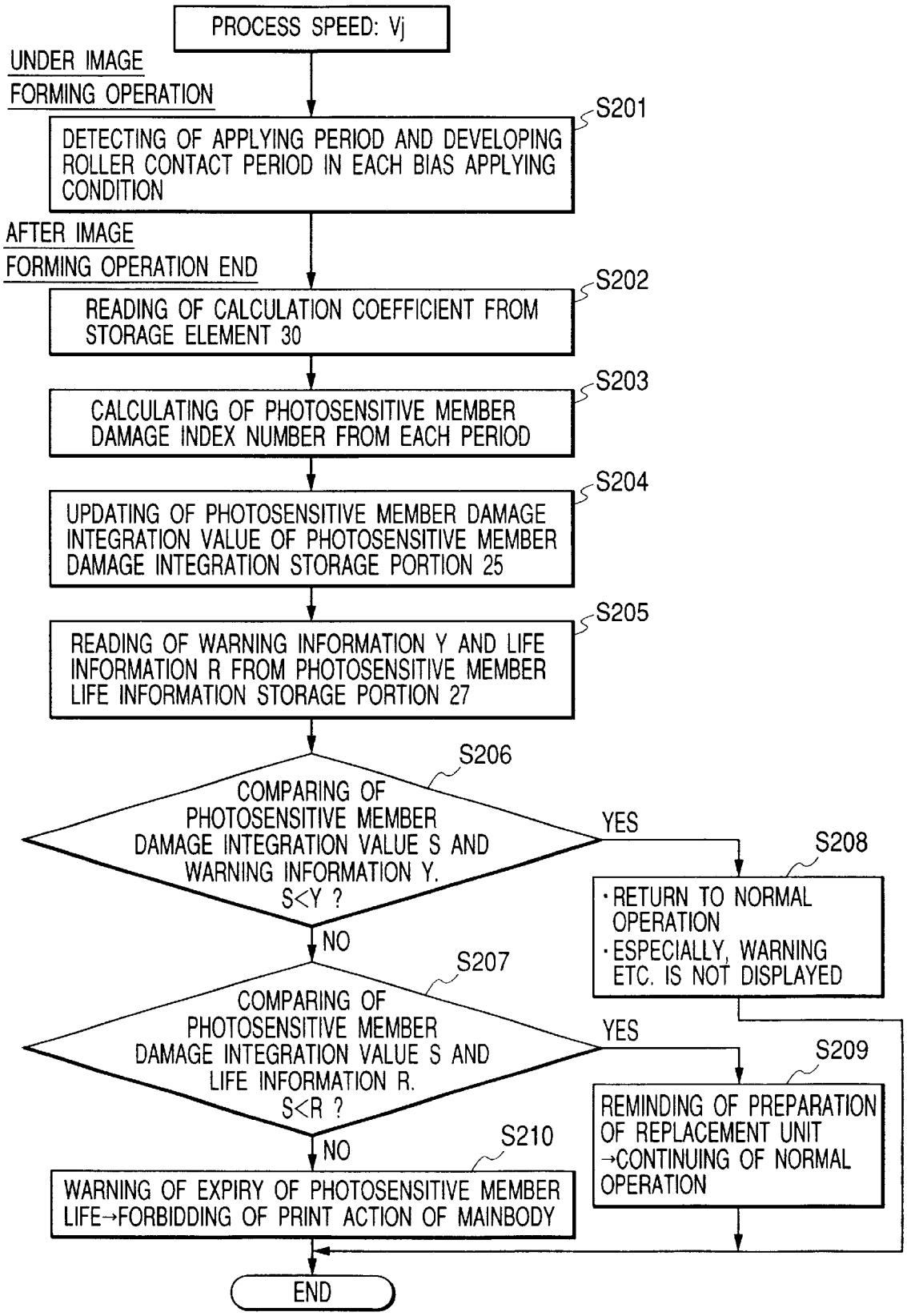
FIG. 6 is a flow chart showing a life detecting method in the second embodiment.

FIG. 6 is a flow chart showing the life detecting method in the second embodiment. Steps S201 to S204 shown in FIG. 6 are identical to steps S101 to S104 in the first embodiment shown in FIG. 5, and a description thereof will be omitted.

After one job of image forming operation ends and updating of the integration value S stored in a photosensitive member damage integration storage portion 25 of the storage device 30 ends through steps S201 to S204, a comparison portion 26 reads the warning information Y and life information R stored in advance in the photosensitive member life information storage portion 27 of the storage device 30 (step S205). The comparison portion 26 reads the updated integration value S from the photosensitive member damage integration storage portion 25 of the storage device 30, and compares the photosensitive member damage integration value S with the warning information Y (step S206). If the updated photosensitive member damage integration value S is smaller than the warning information Y (S<Y), the flow returns to a normal image forming sequence without displaying life warning information of the photosensitive drum 1 (step S208).

If the photosensitive member damage integration value S is equal to or larger than the warning information Y as a result of comparing the photosensitive member damage integration value S with the warning information Y in step S206 (S≧Y), the comparison portion 26 subsequently compares the photosensitive member damage integration value S with the life information R (step S207). If the photosensitive member damage integration value S is smaller than the life information R as a result of comparison (S<R), this means that the life of the photosensitive drum 1 will expire soon. While normal image forming operation continues, an instruction for reminding the user to prepare for replacement is displayed on a photosensitive member life warning portion (display portion) 28 of an apparatus main body 101 (step S209).

If the photosensitive member damage integration value S is equal to or larger than the life information R in step S207 (S≧R), an instruction which notifies the user that the life of the photosensitive drum 1 has expired and which reminds the user to replace the photosensitive drum 1 is displayed on the photosensitive member life warning portion (display portion) 28, and any print action is forbidden (step S210). After it is confirmed that the user has replaced the photosensitive drum 1 with a new one, print action is permitted again.

In the second embodiment, warning information Y and life information R are set as information for determining the life of the photosensitive drum 1. The information may be set in more detail, and the user may be notified of more detailed photosensitive member life information.

As described above, according to the second embodiment, it can be accurately detected that the life of the photosensitive drum 1, i.e., the electrophotographic life has expired or will expire soon. The user can be accurately notified of the replacement time based on the life of the photosensitive drum 1 or that the replacement time is coming soon. The photosensitive drum 1 can always be used in a good condition, and a high-quality image can always be obtained.

THIRD EMBODIMENT

The third embodiment according to the present invention will be described in detail with reference to the accompanying drawings.

An image forming apparatus in the third embodiment is basically the same in arrangement as an image forming apparatus in the first embodiment shown in FIG. 1, and a description thereof will be omitted.

A life detecting method of detecting the life of a photosensitive drum 1 in the third embodiment will be described.

The third embodiment sets two pieces of information for determining the photosensitive drum life, similar to the second embodiment. In the third embodiment, these pieces of information are warning information Y for reminding the user to prepare for replacement when the life of the photosensitive drum 1 will expire soon, and actual photosensitive member life information R. The warning information Y and photosensitive member life information R have a relation: warning information Y<photosensitive member life information R.

In the third embodiment, a photosensitive member life information storage portion 27 of a storage device 30 in a drum unit 40 stores photosensitive member life selection information J, instead of the warning information Y and life information R. The photosensitive member life selection information J is made up of, e.g., 10 pieces of photosensitive member life selection information J in a photosensitive member life information table shown in Table 1. The respective pieces of photosensitive member life selection information J relate to different combinations of warning information Y and life information R.

More specifically, in the third embodiment, a comparison portion 26 holds a photosensitive member life information table representing the relationship between the photosensitive member life selection information J, the warning information Y, and the life information R, as shown in Table 1. The comparison portion 26 selects and uses one of combinations of warning information Y and life information R on the basis of photosensitive member life selection information J read from the storage device 30 in the drum unit 40.

TABLE 1

| | Life, Warning | |
|---|---|---|
| Life Selection Information J | Warning Information Y | Life Information R |
| 0 | 100000 | 150000 |
| 1 | 200000 | 300000 |
| 2 | 100000 | 120000 |
| 3 | 100000 | 20000 |
| 4 | 100000 | 150000 |
| 5 | 100000 | 170000 |
| 6 | 100000 | 180000 |
| 7 | 140000 | 150000 |
| 8 | 145000 | 150000 |
| 9 | 190000 | 200000 |

Figure 7:
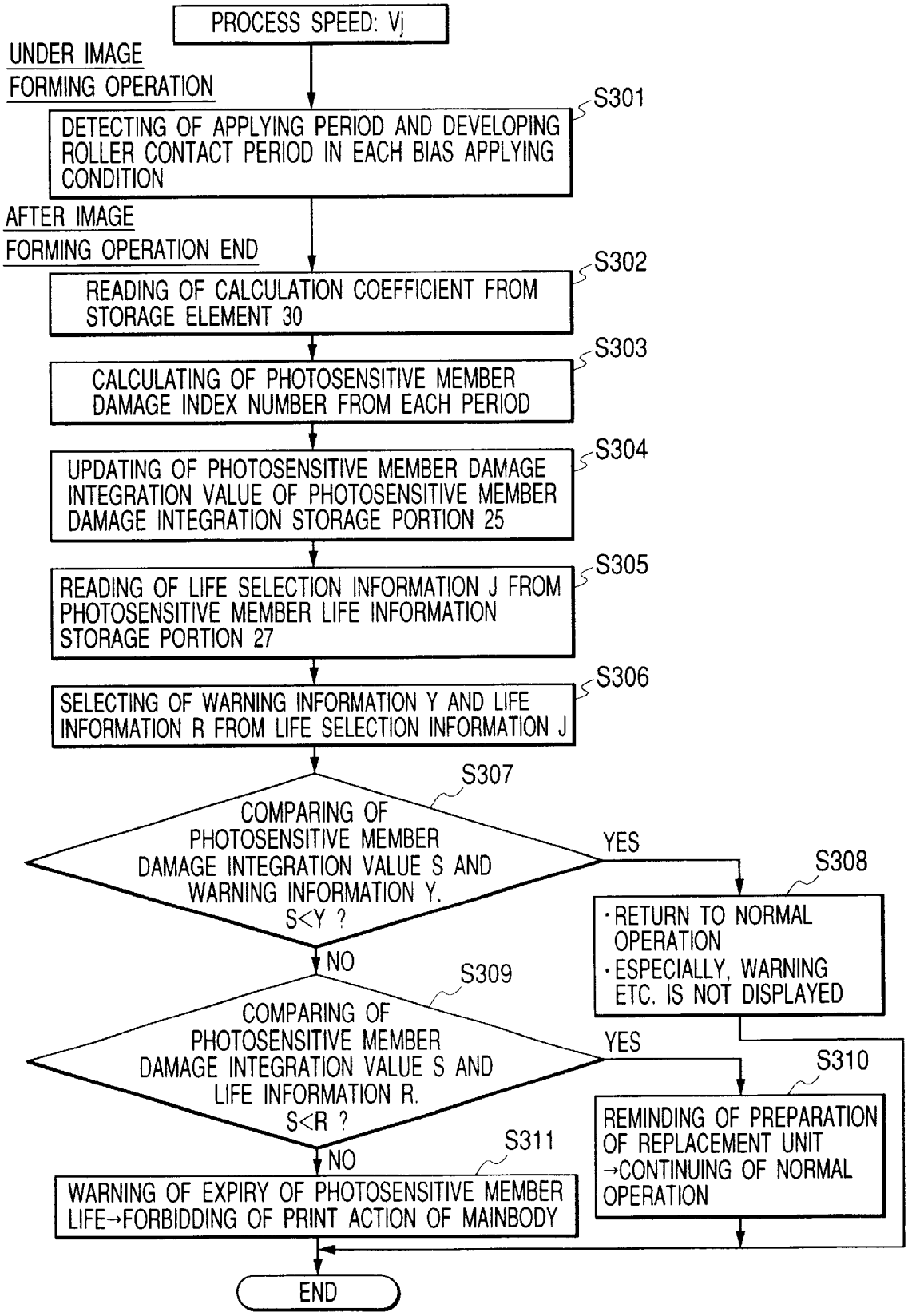
FIG. 7 is a flow chart showing a life detecting method in the third embodiment.

FIG. 7 is a flow chart showing the life detecting method in the third embodiment. Steps S301 to S304 shown in FIG. 7 are identical to steps S201 to S204 in the second embodiment shown in FIG. 6, and a description thereof will be omitted.

After one job of image forming operation ends and updating of the integration value S stored in a photosensitive member damage integration storage portion 25 of the storage device 30 ends through steps S301 to S304, the comparison portion 26 reads photosensitive member life selection information J stored in advance in the photosensitive member life information storage portion 27 of the storage device 30 (step S305). The comparison portion 26 selects warning information Y and life information R from the photosensitive member life information table shown in Table 1 on the basis of the photosensitive member life selection information J (step S306).

The comparison portion 26 reads the updated integration value S from the photosensitive member damage integration storage portion 25, and compares the updated photosensitive member damage integration value S with the warning information Y (step S307). If the updated photosensitive member damage integration value S is smaller than the warning information Y (S<Y), the flow returns to a normal image forming sequence without displaying life warning information of the photosensitive drum 1 (step S308).

If the photosensitive member damage integration value S is equal to or larger than the warning information Y as a result of comparing the photosensitive member damage integration value S with the warning information Y in step S307 (S≧Y), the comparison portion 26 subsequently compares the photosensitive member damage integration value S with the life information R (step S309). If the photosensitive member damage integration value S is smaller than the life information R as a result of comparison (S<R), this means that the life of the photosensitive drum 1 will expire soon. While normal image forming operation continues, an instruction for reminding the user to prepare for replacement is displayed on a photosensitive member life warning portion (display portion) 28 of an apparatus main body 101 (step S310).

If the photosensitive member damage integration value S is equal to or larger than the life information R in step S309 (S≧R), an instruction which notifies the user that the life of the photosensitive drum 1 has expired and which reminds the user to replace the photosensitive drum 1 is displayed on the photosensitive member life warning portion (display portion) 28, and any print action is forbidden (step S311). After it is confirmed that the user has replaced the photosensitive drum 1 with a new one, print action is permitted again.

In the third embodiment, the storage device 30 stores the photosensitive member life selection information J, instead of the warning information Y and life information R. This can reduce information held in the storage device 30, the capacity of the storage device 30, and the cost of the storage means.

In the third embodiment, the comparison portion 26 reads out the photosensitive member life selection information J stored in the storage device 30 every job of image forming operation. Alternatively, the photosensitive member life selection information J may be read out once only when the apparatus main body 101 is powered on.

As described above, according to the third embodiment, it can be accurately detected that the life of the photosensitive drum 1, i.e., the electrophotographic life has expired or will expire soon. The user can be accurately notified of the replacement time based on the life of the photosensitive drum 1 or that the replacement time is coming soon. The photosensitive drum 1 can always be used in a good condition, and a high-quality image can always be obtained. In addition, the arrangement in the third embodiment requires a small cartridge capacity.

FOURTH EMBODIMENT

The fourth embodiment according to the present invention will be described in detail with reference to the accompanying drawings.

Figure 8:
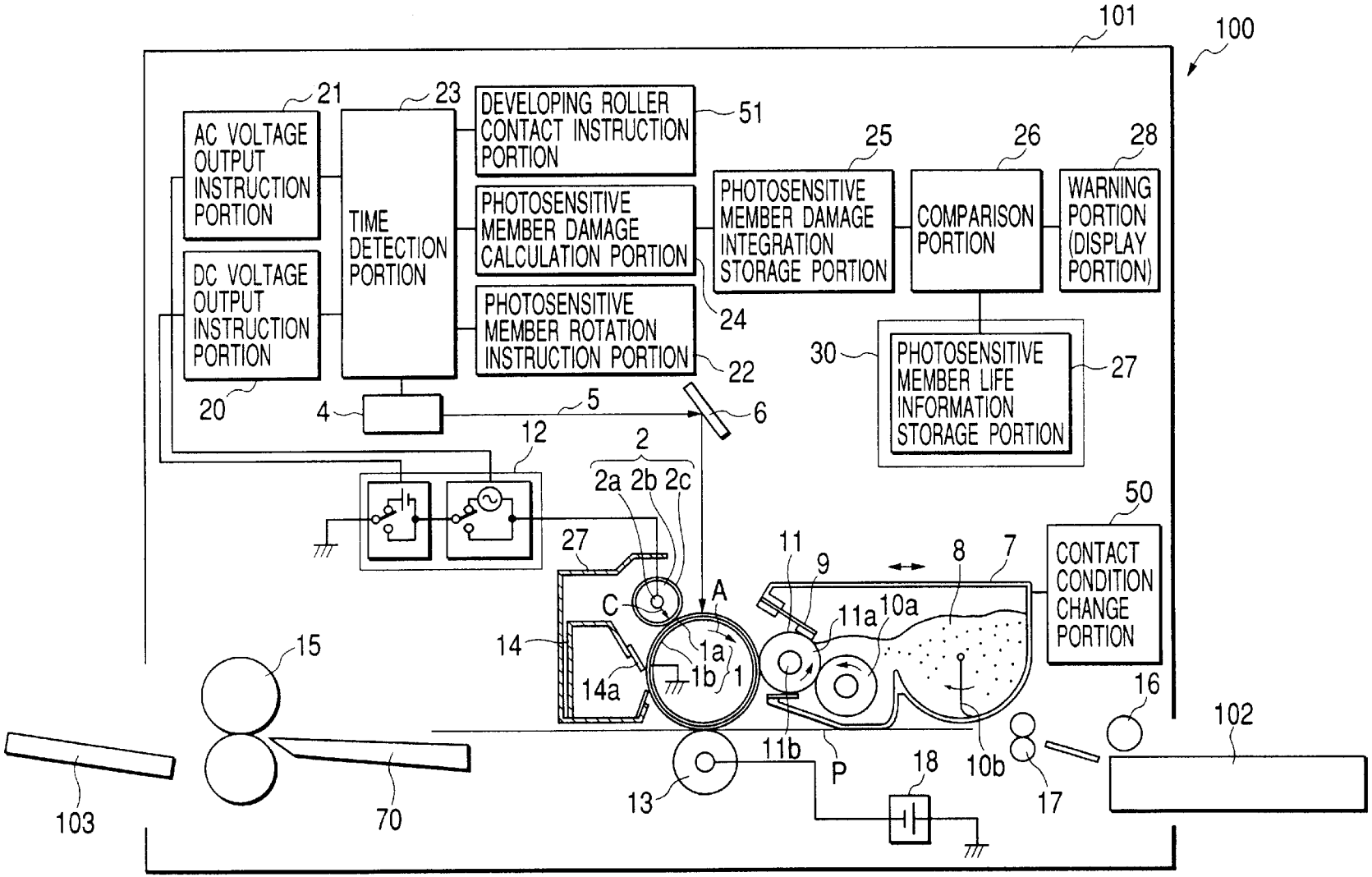
FIG. 8 is a schematic block diagram showing an image forming apparatus in the fourth embodiment.

In the image forming apparatuses according to the first to third embodiments described above, the drum unit (process cartridge) 40 including at least the photosensitive drum is detachably attachable to the apparatus main body 101 as a cartridge detachably attachable to the apparatus main body 101, and the storage device 30 is mounted in the drum unit 40. In the fourth embodiment, as shown in FIG. 8, a photosensitive member damage integration storage portion 25, photosensitive member life information storage portion 27, and the like are mounted in an apparatus main body 101 in an arrangement in which electrophotographic image forming process means (electrophotographic photosensitive member, electrostatic charging means, developing means, and cleaning means) are not mounted as an integral process cartridge system, but are independently mounted in the image forming apparatus main body 101.

The photosensitive member damage integration storage portion 25 and photosensitive member life information storage portion 27 can be constituted into an integral storage device. In the fourth embodiment, a photosensitive member damage calculation portion 24 holds photosensitive member damage calculation coefficient information (ki and kd).

The fourth embodiment can also apply processing described in the first to third embodiments to obtain almost the same operation effects as those in the first to third embodiments. The processing and effects have already been described in the first to third embodiments, and a description thereof will be omitted.

In each of the above embodiments, the apparatus main body 101 comprises the warning portion (display portion) 28 as a notifying means for notifying the user that the life of the photosensitive drum 1 has expired or will expire soon. However, the present invention is not limited to this. For example, the notifying means can be the screen (display) of a device such as a host computer connected to the image forming apparatus main body 101 so as to communicate with each other. The notifying means can include notification using a warning message or sound, or recording/output on a recording medium. The notifying means can employ any method as far as the user can recognize the residual amount of developer.

MODIFICATION

In this modification, the photosensitive member damage index number D in the embodiments is calculated using the coefficient kj corresponding to the process speed Vj. That is, the damage index number D is calculated by the following equation. The coefficients k1, k2, k3, and kd are constant regardless of the process speed, and the number of stored coefficients can be decreased.

$$D=kj\times(k1\times t1+k2\times t2+k3\times t3+kd\times td)$$

The damage index number in this modification can also attain almost the same effects including life determination as those in the above embodiments.

Note that the present invention may be applied to a system constituted by a plurality of devices (e.g., host computer, interface device, reader, and printer), or to an apparatus formed from one device.

The objects of the present invention can also be achieved when a storage medium bearing software program codes for realizing the functions of the above-described embodiments is supplied to the system or apparatus, and the computer (CPU or MPU) of the system or apparatus reads out and executes the program codes stored in the storage medium.

In this case, the program codes read out from the storage medium realize the functions of the above-described embodiments, and the storage medium which stores the program codes constitutes the present invention.

The storage medium for supplying program codes is, e.g., a floppy disk, hard disk, optical disk, magneto-optical disk, CD-ROM, CD-R, magnetic tape, nonvolatile memory card, or ROM.

The functions of the above-described embodiments are realized by executing readout program codes by the computer. The functions of the above-described embodiments are also realized by performing part or all of actual processing by an OS (Operating System) running on the computer.

The functions of the above-described embodiments are also realized by the following processing. That is, program codes read out from the storage medium are written in the memory of a function expansion board inserted into the computer or the memory of a function expansion unit connected to the computer. Then, the CPU of the function expansion board or unit executes part or all of actual processing on the basis of the instructions of the program codes.

The present invention has been described by exemplifying several preferred embodiments, but the present invention is not limited to them. Various changes and modifications can be made within the spirit and scope of the appended claims.

As has been described above, according to the embodiments, it can be accurately detected that the life of an image bearing member has expired or will expire soon. The user can be accurately notified of the replacement time based on the life of the image bearing member or that the replacement time is coming soon.

It can also be accurately detected that the life of the image bearing member has expired or will expire soon even when an image is formed at a plurality of process speeds, the image bearing member is electrostatically charged under a plurality of electrostatic charge conditions, and the developing means can be separated from or brought into contact with the image bearing member.

What is claimed is:

1. A memory device to be mounted on a process cartridge, which includes an image bearing member and developing means whose contact or separation status with respect to the image bearing member is changeable, and which is detachably attachable to an image forming apparatus, which develops an electrostatic latent image on the image bearing means by contact of the developing means to the image bearing member at one of a plurality of process speeds, said memory device comprising:

a first memory portion for storing parameters according to each process speed, for calculating data on the degree of damage to the image bearing member on the basis of a contact period during which the developing means contacts the image bearing member; and a second memory portion into which data on the integration of the calculated damage degree data of the image bearing member is to be written.

2. A memory device according to claim 1, wherein the parameter stored in said first memory portion comprises the coefficients of the contact period for calculating the damage degree data.

3. A memory device according to claim 1, further comprising:

a third memory portion for storing data about the life of the image bearing member.

4. A memory device according to claim 3, wherein the data stored in the third memory portion comprises data to be compared with the integrated damage degree data to produce a warning that the life of the image bearing member has expired.

5. A memory device according to claim 4, wherein the data stored in the third memory portion further comprises data to be compared with the integrated damage degree data to determine whether the life of the image bearing member will expire soon.

6. A memory device according to claim 3, wherein the data stored in the third memory portion comprises life selection data relating to the selecting of image bearing member life data based on a table representing the relationship between the life selection data and the image bearing member life data.

* * * * *